United States Patent [19]

Paugh

[11] Patent Number: 4,753,395

[45] Date of Patent: Jun. 28, 1988

[54] LUMP BREAKER FOR FOOD PROCESSING

[75] Inventor: George W. Paugh, St. Louis, Mo.

[73] Assignee: Ralston Purina Company, St. Louis, Mo.

[21] Appl. No.: 9,316

[22] Filed: Jan. 28, 1987

[51] Int. Cl.[4] ..... B02C 13/28

[52] U.S. Cl. ..... 241/88.4; 241/190; 241/243

[58] Field of Search ..... 241/243, 88, 88.4, 89.3, 241/190

[56] References Cited

U.S. PATENT DOCUMENTS

| | | | |
|---|---|---|---|
| Re. 11,634 | 10/1897 | Williams | 241/88.4 |
| 105,881 | 8/1870 | Aubin . | |
| 499,535 | 6/1893 | Genevois . | |
| 973,761 | 10/1910 | Cline | 241/225 |
| 1,916,190 | 7/1933 | Bowerman | 241/89.3 |
| 1,975,406 | 10/1934 | Reschke | 241/89.3 |
| 2,068,450 | 1/1937 | Elberly | 83/6 |
| 2,280,211 | 4/1942 | Bernhardt | 146/123 |
| 2,828,923 | 4/1958 | Kramer | 241/190 X |
| 3,141,485 | 7/1964 | Bonner, Jr. et al. | 146/117 |
| 3,154,622 | 10/1964 | Reinfeld et al. | 266/20 |
| 3,463,406 | 8/1969 | Musgrave | 241/190 X |
| 3,708,127 | 1/1973 | Brewer | 241/32 |
| 4,489,896 | 12/1984 | Cerroni | 241/243 X |

FOREIGN PATENT DOCUMENTS

| | | | |
|---|---|---|---|
| 8868 | 1/1978 | Japan | 241/190 |

*Primary Examiner*—Mark Rosenbaum
*Attorney, Agent, or Firm*—Virgil B. HIll

[57] ABSTRACT

Apparatus for disintegrating large food particles, particularly sticky food particles, in which a plurality of breaker blades spaced along a rotating shaft pass between a plurality of spaced breaker bars. Each of the breaker bars having an inwardly extending arm whereby large food particles which are not passed through the breaker bars are carried by the breaker blades into the inwardly extending arms to be reduced in size.

1 Claim, 2 Drawing Sheets

LUMP BREAKER FOR FOOD PROCESSING

BACKGROUND OF THE INVENTION

In the treatment and handling of certain food products it is necessary to disintegrate or reduce in size large chunks or particles of material. Difficulty is experienced in reducing the size of material which is sticky, such as hot cooked cereal grains.

Apparatus in the known art typically have blades or hammers which beat the material against the sides of a container until the material is reduced in size and can pass through openings provided in the container. Other apparatus utilize cutting blades to cut the material so it may pass or be forced through spaced bars.

It is the intent of the present invention to provide a lump breaker apparatus which is effective in reducing the particle size of food products and particularly sticky food products.

It is the further intent of the present invention to provide a lump breaker apparatus which shears the large particles of the material in a manner such that the sheared particles are reintroduced above the breaker bars for repeated disintegration or passage between the breaker bars.

SUMMARY OF THE INVENTION

A lump breaker apparatus is provided with a frame having a rotatable shaft on which are positioned a plurality of spaced breaker blades. Each of the breaker blades is positioned to pass between spaced breaker bars positioned on the frame. The breaker bars including an inwardly extending arm such that as the breaker blades are rotated, material introduced between the breaker blades and the breaker bars will pass through the breaker bars or be carried by the breaker blades into the arms which shears the large particles and these particles are then reintroduced above the breaker bars for repeated disintegration or passage between the breaker bars.

BRIEF DESCRIPTION OF THE DRAWINGS

In the following description and in the Claims, parts will be identified by specific names for convenience, but such names are intended to be as generic in their application to similar parts as the art will permit. Like reference characters demote like parts in the several figures in the drawings, in which:

DESCRIPTION OF THE PREFERRED EMBODIMENTS

Figure 1:
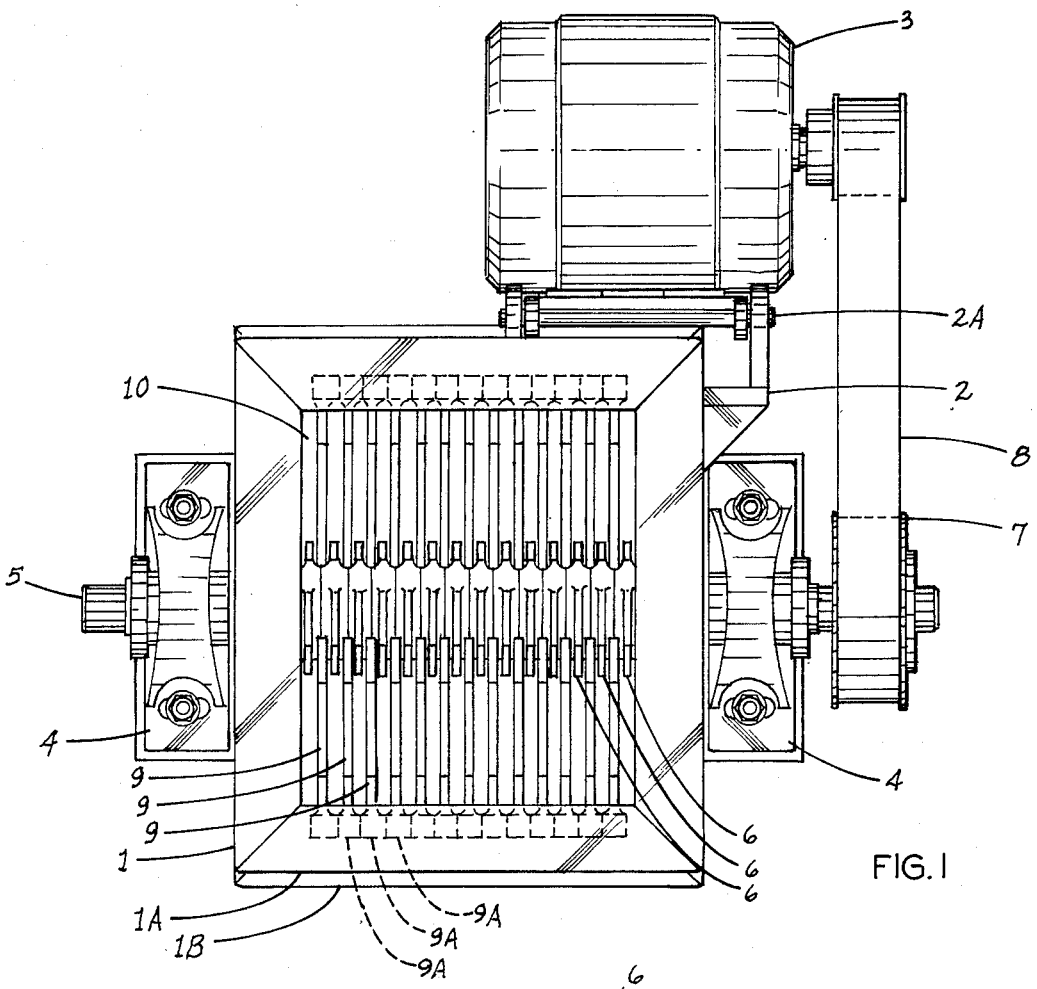
FIG. 1 is a top view of the lump breaker apparatus, in accordance with the present invention.
Figure 2:
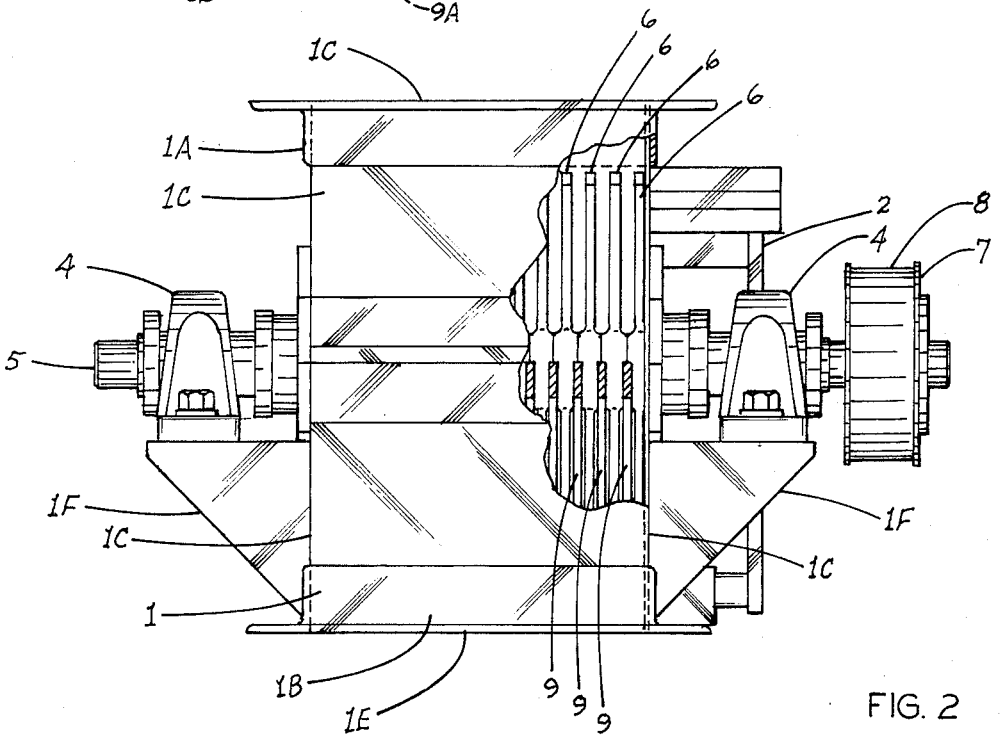
FIG. 2 is a side view of the apparatus of FIG. 1.
Figure 3:
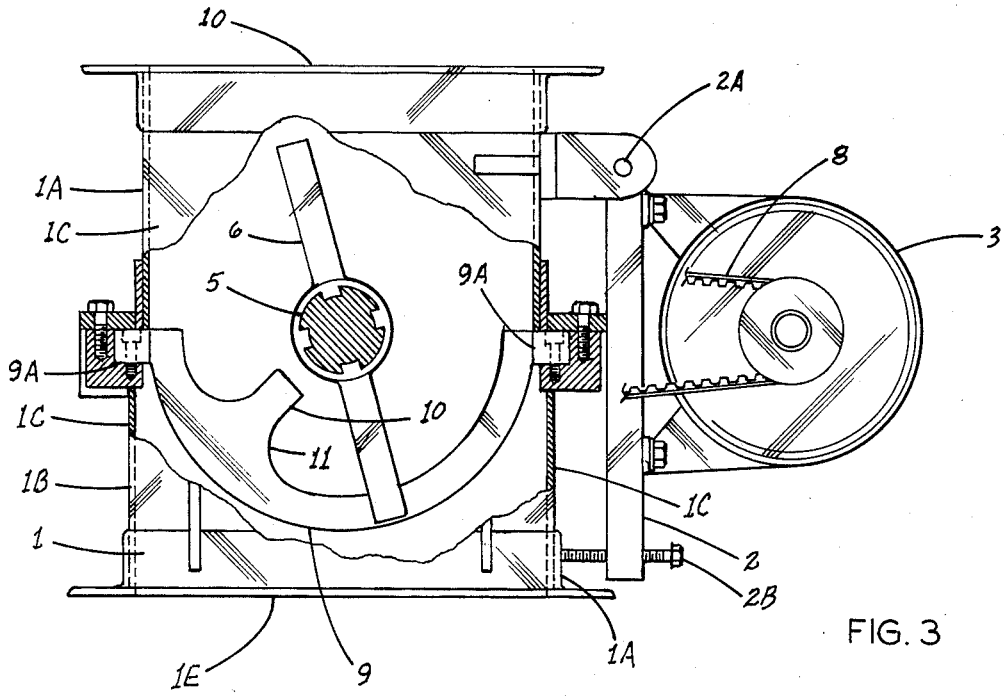
FIG. 3 is an end view of the apparatus of FIG. 1.
Figure 4:
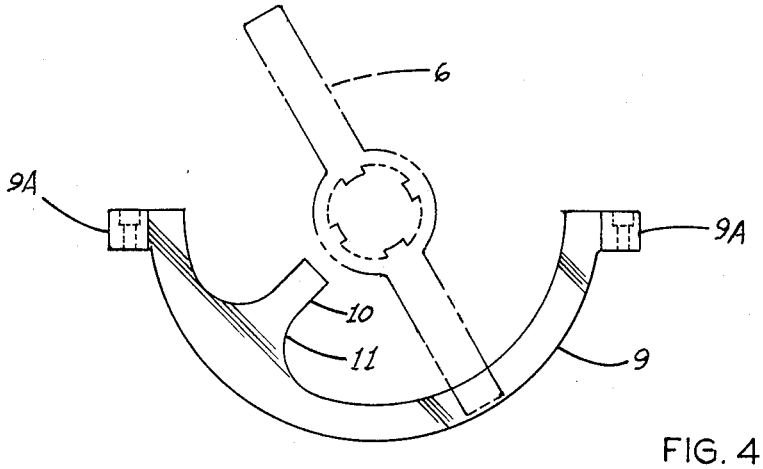
FIG. 4 is a side view of one of the breaker bars.
Figure 5:
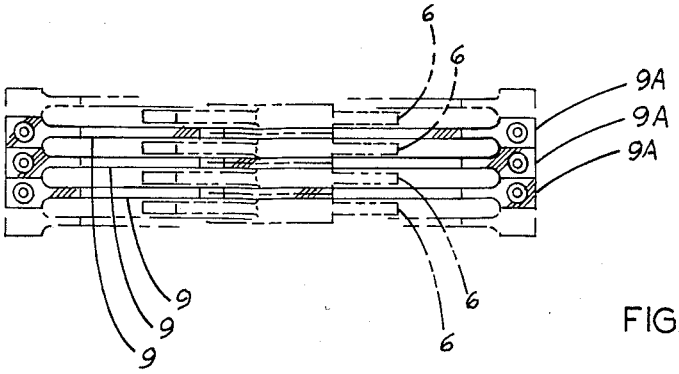
FIG. 5 is a top view of the breaker bar of FIG. 4.

Referring to the drawings, a frame or housing 1 is provided with an upper housing 1A and lower housing 1B which provides four side walls 1C and defines an inlet hopper 1D and a discharge opening 1E. A motor support bracket 2 is provided on one of the side walls 1C of the housing 1 by means of a pivot pin assembly 2A. A bolt 2B is provided in the motor support bracket 2 for engagement with the housing wall 1A and for positioning the motor support bracket 2. A drive motor 3 is bolted on and connected to the support bracket 2 and is provided with a suitable energy source (not shown). The housing 1A is provided with flanges 1F on which are bolted bearings 4 which support a shaft 5 centrally in the housing 1. Suitable sealing on the sidewall 1C of the housing 1 at the entry points of the shaft 5 are provided to permit the handling of food products. Connected to the shaft 5 at spaced intervals are a plurality of breaker blades 6. These blades 6 may be connected by any suitable means and in the preferred embodiment are uniformly aligned on the shaft. It may be desirable, depending on the material being processed to have the blades positioned at various angles to one another. In the preferred embodiment of the invention. the blades 6 are perpendicular to the shaft 5. The shaft 5 at one end includes a sprocket 7 which is connected to the motor 2 by a drive belt 8.

Mounted to and positioned between the upper housing 1A and lower housing 1B are a plurality of breaker bars 9. Each breaker bar 9 is provided with flanged ends 9A which when positioned next to the adjacent breaker bars 9 provides a predetermined spacing between the breaker bars 9 which is slightly greater than the width of the breaker blades 6. Preferably each of the breaker bars 9 will be bolted to the lower housing 1B with the upper housing 1A overlapping the flanged ends 9A and the upper housing 1A then being bolted to the lower housing 1B. Each breaker bar 9 has a curvature which when placed in the housing 1 conforms to the path of the outer most point on the breaker blade 6 and permits the breaker blades 6 to extend between and through the openings formed between the breaker bars 9. Each breaker bar 9 includes an arm portion 10 which extends inward substantially to the rotatable shaft 5. The arm portion 10 at 11 is provided with an inward curvature or angle to the breaker bar 9 and path of the breaker blades 6 to cause material which is carried into the arms 10 to be reintroduced between the blades and bars as will more fully be discussed in the operation of the apparatus.

In the operation of the apparatus, the motor 3 is activated and the breaker blades 6 are rotatability driven by the shaft 5. The material which is to be disintegrated is introduced into the hopper 1D and the breaker blades 6 carry the material around to the breaker bars 9. The material which is small enough in size will be forced through the breaker bars 9 by the breaker blades 6 through the opening in the housing 1 for subsequent processing or use. The larger pieces will be carried by the breaker blades 6 into the arms 10. These large particles are subjected to shearing action as the breaker blades 6 pass through the arms 10 with the curvature of the arm 11 being sufficient to reintroduce the sheared large particles to the area above the breaker bars 9. This shearing and reintroduction of material would be continued until the material is reduced in size sufficiently to be forced between the breaker bars 9 by the breaker blades 6.

While the invention has been described and illustrated with respect to a certain preferred example, it will be understood by those skilled in the art after understanding the principle of the invention, that various changes and modifications may be made without departing from the spirit and scope of the invention.

I claim:

1. A lump breaker apparatus comprising a frame, a plurality of breaker bars mounted on said frame and spaced from one another along said frame, a rotatable shaft supported by said frame, a plurality of breaker blades attached to said rotatable shaft and positioned along said shaft to pass between said breaker bars, each of said breaker bars including first and second portions and an arm intermediate to the portions, said arm portion extending inwardly substantially toward said rotatable shaft and having an inward curvature sufficient so that material will first be forced by the breaker blades to said arm portion where the larger pieces are sheared by the cooperation of said arm portion and breaker blades and are reintroduced to the arm portion and breaker blades for further shearing.

* * * * *